US006605786B2

(12) United States Patent
Juret et al.

(10) Patent No.: US 6,605,786 B2
(45) Date of Patent: Aug. 12, 2003

(54) ELECTRICAL SWITCH SINGLE SLIDING/ ROTARY ACTUATOR

(75) Inventors: Bernard Juret, Gilssav (FR); Alain Janniere, Paris (FR)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 10/045,807

(22) Filed: Jan. 10, 2002

(65) Prior Publication Data

US 2002/0079200 A1 Jun. 27, 2002

Related U.S. Application Data

(63) Continuation-in-part of application No. PCT/EP00/06051, filed on Jun. 29, 2000.

(30) Foreign Application Priority Data

Jul. 21, 1999 (FR) ..... 99 09440

(51) Int. Cl.[7] ..... H01H 9/00

(52) U.S. Cl. ..... 200/4; 200/11 R; 200/406; 200/18

(58) Field of Search ..... 200/4, 11 R, 11 D, 200/11 DA, 11 G, 11 H, 18, 336, 406

(56) References Cited

U.S. PATENT DOCUMENTS

| | | | | |
|---|---|---|---|---|
| 4,365,120 A | * | 12/1982 | Pounds | 200/5 A |
| 4,412,113 A | * | 10/1983 | Mitsugi et al. | 200/406 |
| 4,866,219 A | | 9/1989 | Riding et al. | 200/4 |
| 5,180,050 A | | 1/1993 | Rada et al. | 200/329 |
| 5,451,285 A | * | 9/1995 | Santo et al. | 200/516 |
| 5,705,778 A | * | 1/1998 | Matsui et al. | 200/11 R |
| 5,847,335 A | | 12/1998 | Sugahara et al. | 200/4 |
| 6,049,044 A | * | 4/2000 | Mizobuchi | 200/4 |
| 6,184,480 B1 | * | 2/2001 | Nishimoto et al. | 200/4 |
| 6,396,006 B1 | * | 5/2002 | Yokoji et al. | 200/4 |

FOREIGN PATENT DOCUMENTS

| | | | |
|---|---|---|---|
| DE | 29901900 U1 | 6/1999 | H01H/19/00 |
| EP | 0644402 A1 | 3/1995 | G01D/5/25 |
| EP | 0717424 A2 | 6/1996 | H01H/25/06 |

* cited by examiner

*Primary Examiner*—Michael Friedhofer
(74) *Attorney, Agent, or Firm*—Roger C. Turner

(57) ABSTRACT

An electrical switch assembly includes a dome-shaped switching element (100) that closes a switch when the dome center portion (118) is depressed against a terminal (104, 106), wherein an actuator member (36) has a lower portion (44) that extends through a hole (120) in the dome element and into a bore (46) that guides the actuator member lower portion in sliding movement. A coding wheel (52) that is fixed to the actuator member, includes a conductive portion (60) with at least one contacting tooth (62) and a non-contacting part or space (200) that both lie on an imaginary circle (220). A plurality of pairs of contacts (74, 84, 86) are in vertical alignment with the circle, and each contacting tooth engages a selected pair of the contacts in a selected rotational position of the actuation member about its vertical axis A.

11 Claims, 4 Drawing Sheets

ELECTRICAL SWITCH SINGLE SLIDING/ ROTARY ACTUATOR

CROSS-REFERENCE TO RELATED APPLICATION

This is a continuation-in-part of PCT application PCT/EP00/06051 filed Jun. 29, 2000 which designates the United States, and claims priority from French application 99/09440 filed Jul. 21, 1999.

BACKGROUND OF THE INVENTION

Many devices requires several switches for operation. For example, one type of portable telephone allows the user to store a series of telephone numbers and allows the user to call a selected telephone number without having to dial that number. For this purpose, the telephone has a display screen that lists the stored numbers, with each party's name beside a number. A user operates a first or second switch to scroll the list up or down. Once the user has selected the party to call, the user then operates a third switch to automatically call the displayed telephone number. The requirement to provide three separate switches increases the area occupied by the device and the complexity for mounting the switches, and introduces inconvenience because the user has to move his hand between three separate switches. A single actuation member of simple design and very small size, which enabled a user to perform all three functions, would be of value.

SUMMARY OF THE INVENTION

In accordance with one embodiment of the present invention, an electric switch assembly is provided which enables the performance of a plurality of switching functions in a switch assembly of small size and simple design. The switch assembly includes a housing with bores extending along a vertical axis, and an actuation member which is moveable vertically along the axis. A dome-shaped switching element is located in the housing and has a center that can be depressed by the actuation member to close a switch. The actuation member has a lower portion that extends through a hole in the center of the dome switching element and that is slidably guided at the bottom of the housing which lies below the switching element. The actuation member can be turned in opposite directions, and is fixed to a coding wheel. In a neutral rotational position, the coding wheel does not close any contacts. However, when the coding wheel is turned to the left or right, contacting parts of the coding wheel engage one or another pair of contacts to close a second or third switch.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
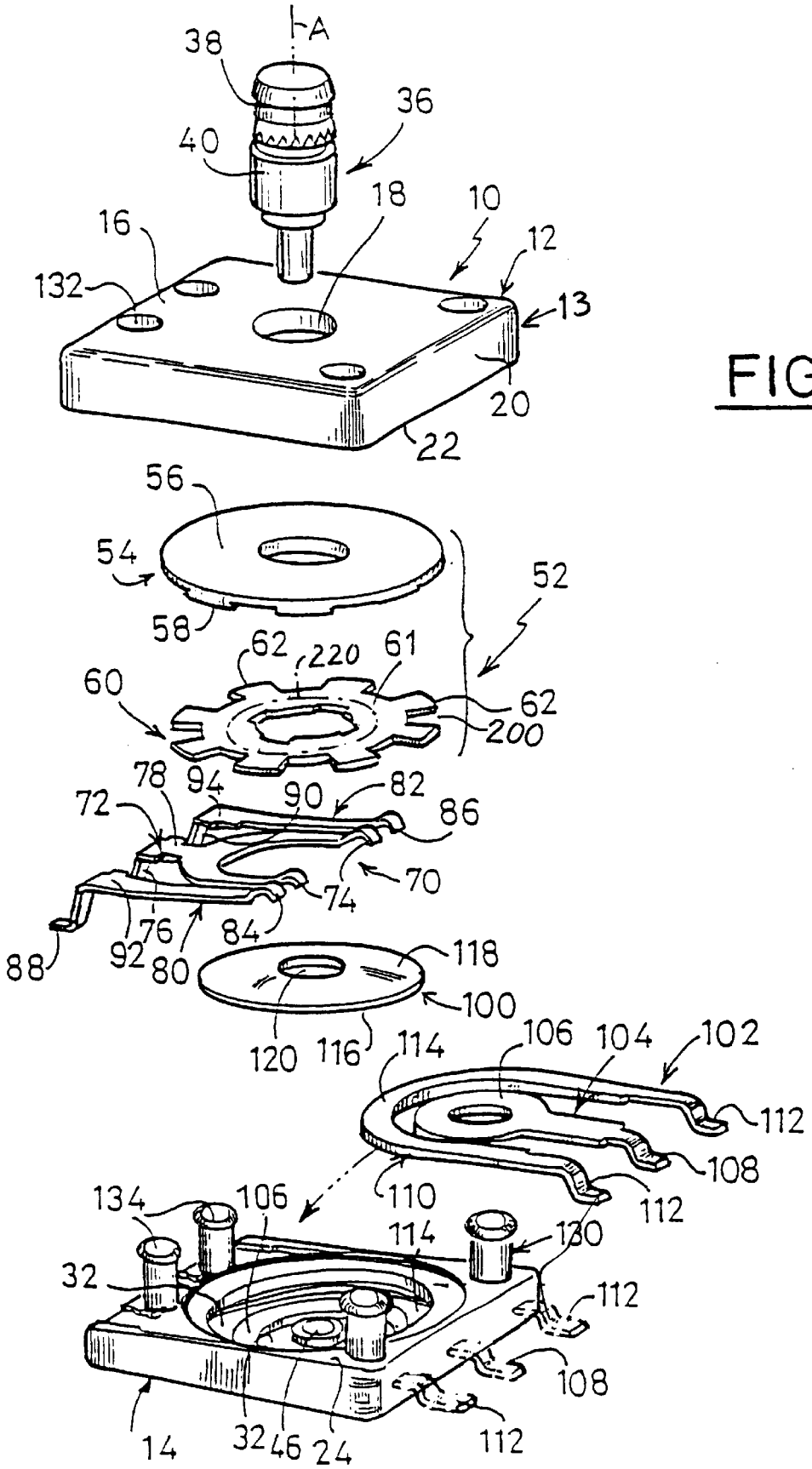
FIG. 1 is an exploded isometric view of a switch assembly of the present invention, with the first and second terminals shown offset.
Figure 2:
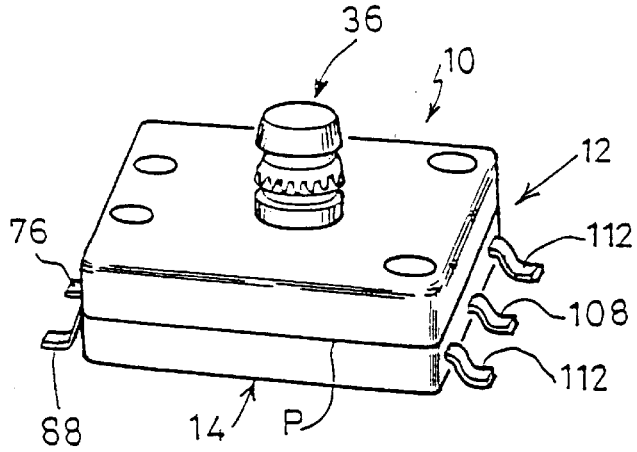
FIG. 2 is a top isometric view of the switch assembly of FIG. 1, in a fully assembled condition.

FIG. 1 illustrates a switch assembly 10 of the present invention, which includes an insulative housing 13 with upper and lower parts 12, 14 that are joined by posts 130 of the lower part projecting through holes 132 of the upper part and being fixed as by heat staking. Major components of the switch include a single actuation member 36 that can move along a vertical axis A and that can pivot about that axis. A coding wheel 52 turns with the actuation member, so that one or more tooth-like contacting parts 62 can engage pairs of contacts such as 74 and 84 or 74 and 86. Spaces 200 between the contacting parts 62 can lie aligned with the pairs of contacts to not engage at least one contact of either of the two switches.

Another switch is formed by a domed-shaped switch element 100 whose periphery 116 is in constant engagement with a part 114 of a second terminal 110, and whose center portion 118 can be deflected down against a first terminal 106, to close a third switch.

Figure 3:
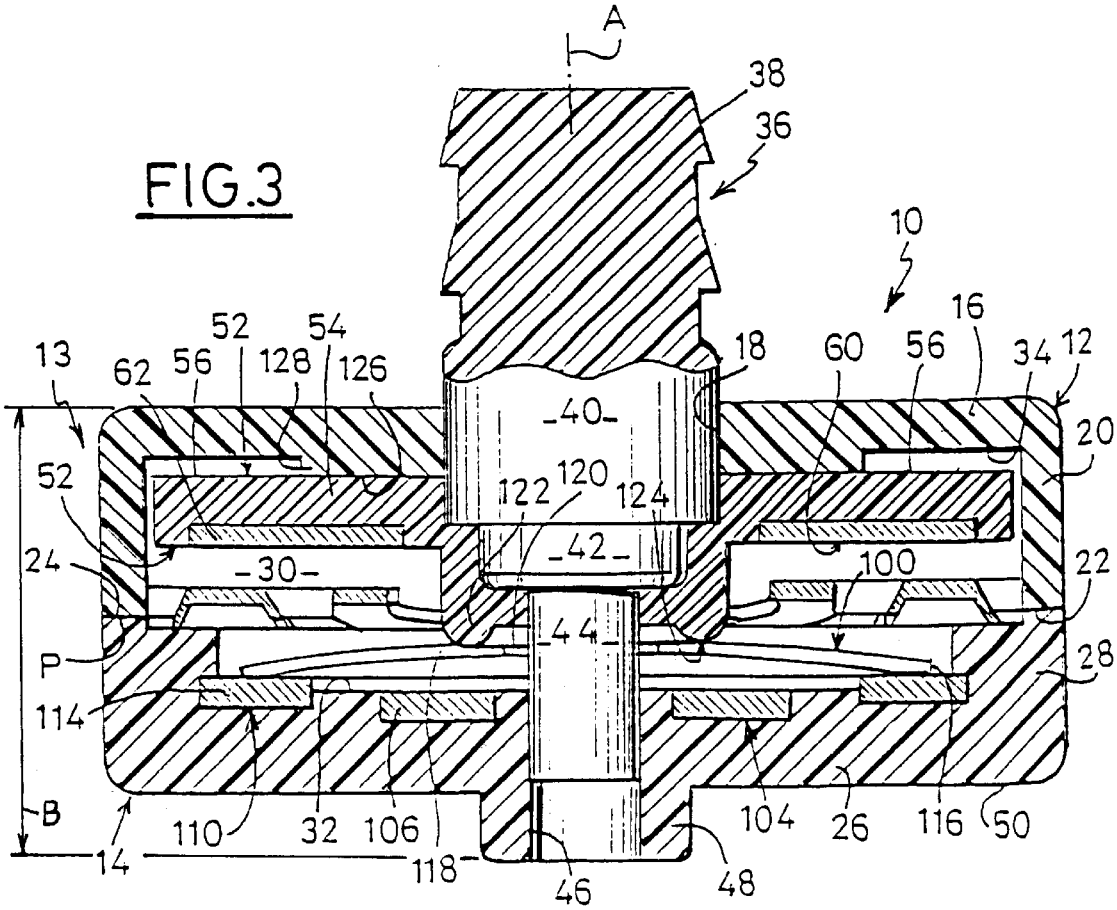
FIG. 3 is a sectional side view of the switch assembly of FIG. 1, with the actuator in its initial, upward position, and is a view taken on line 3—3 of FIG. 6.

The upper part 12 of the housing includes a largely rectangular upper wall 16 with a cylindrical center hole 18. Upper side walls 20 have a lower face 22 which can bond and seal facewise to an upper face 24 of the lower housing part 14. FIG. 3 shows that the sealing occurs along a horizontal sealing plane P at the top of the lower side walls 28. The housing walls form an internal cavity 30 which has upper and lower cavity walls 34, 32.

The actuation member 36 is molded of plastic, with an upper portion having notches to facilitate turning and with a largely flat upper end for depression by a finger. The actuation member has an upper portion 40 that is slideable along the axis A and that can turn or pivot about the axis. An intermediate portion 42 is of smaller diameter than the upper portion 40 and lies below it. The actuation member has a lower portion 44 that extends into a cylindrical hole 46 in the lower wall of the housing. Thus, the actuation member 36 is guided in vertical sliding and in rotation by bores 18, 46 in walls with bore portions that are spaced apart by a large distance B equal to the overall height of the housing. It is noted that the invention allows the switch assembly 10 to be of relatively small height such as where the housing has a height B (FIG. 3) such as 2.75 mm for a switch that permits individual operation of three switches using a single actuation member.

Figure 6:
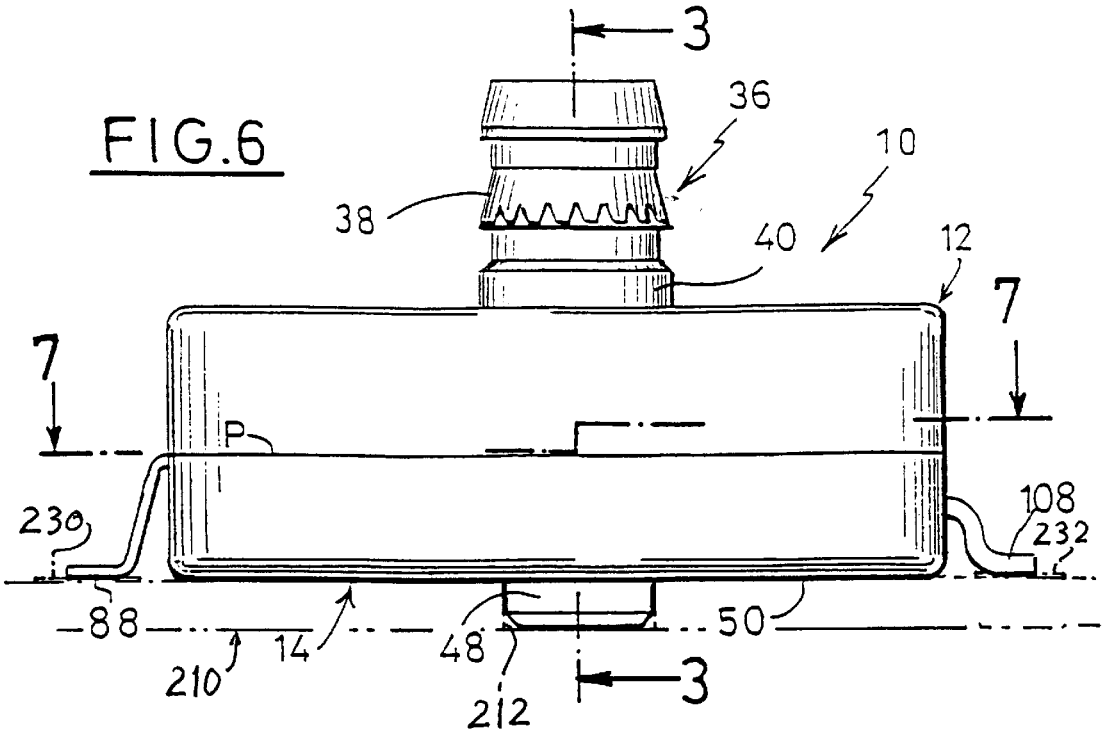
FIG. 6 is a side elevation view of the switch of FIG. 2.

Applicant provides the lower wall with a downward projection 48 that extends below the lower wall 50 of most of the housing. As shown in FIG. 6, the switch can be mounted on a circuit board 210, with the downward projection 48 projecting into a hole 212 drilled in the circuit board. This allows the switch to use much of the thickness of the circuit board to provide a switch of very small height but with the actuation member 36 reliably guided in vertical movement and rotation.

FIG. 1 shows that the coding wheel 52 includes both the conductive element 60 which has conductive teeth 62 and spaces 200, and an insulating plastic disc 54 with an upper face 56 and with a lower face 58 that has recesses that receive the conductive element 60. The conductive element is shown as being in the form of a star wheel, with eight branches forming the contacting teeth 62, and with eight spaces 200. The conductive teeth 62 and the nonconductive spaces 200 lie on an imaginary circle 220.

As shown in FIG. 3, the central part of the insulative disc 54 closely receives portions 40, 42 of the actuation member, preferably in a press fit that prevents rotational slippage between the disc and the actuation member. As shown in FIG. 1, when the actuation member 36 is turned, as to the left, one of the contacting portions 62 engages contact end 86 and an adjacent contact end 74 to close a switch and allow current to pass through a center contact element 72 and one side contact element 82. At that time, one of the spaces 200 is aligned with the contact end 84. When the actuation member is turned in the opposite direction, one of the contacting teeth 62 engages the contact end 84 and an adjacent one of the contact ends 74 to allow current to pass through the center contact element 72 and a side contact element 92. Each of the contact ends 84, 86, 72 are curved to have convex upper surfaces to facilitate turning of the star element 60, and the contact ends lie aligned with the imaginary circle 220.

Each of the contacts have solder tabs 76, 88, 90 that project out of the housing. As shown in FIG. 6, each of the tabs such as 88 can be soldered to a trace 230 on the circuit board 210.

FIG. 3 shows that the dome-shaped switching element 100 has a periphery 116 that lies against the first terminal 110. In the rest position shown in FIG. 3, a collar 122 of the coding wheel slightly depresses the dome switching element. The dome switching element serves not only as a switch contact, but also as a spring that biases the collar 122 and actuation member 36 upwardly. A lower surface 126 of the housing upperwall limits upward movement of the coding wheel and actuation member. The collar 122 that presses against the switching element, has a convex lower surface that extends in a ring about the axis A. The dome switching element has a second part 118 at its center which lies above a second terminal part 106 of the second terminal 104. When the actuation member 36 is depressed, the collar 122 depresses the center part 118 against the second terminal part 106, to close the switch formed by the dome switching element 110 and the terminals 102, 104. As shown in FIG. 1, the terminals 102, 104 have solder tabs 112, 108 that project out of the housing and, as shown in FIG. 6, engage traces 232 on the circuit board.

The domed switching element 100 shown in FIG. 3, has a central hole 120. The lower portion 44 of the actuation member extends through the hole 120 and into the cylindrical hole 46 in the housing lower wall. It would be possible to slidably mount the actuation member 36 only on the upper wall 16. However, this could result in the actuation member 36 tilting and jamming in place, or the upper wall would require a tall projection to provide a long hole 18. Applicant's solution of forming a hole 120 in the dome switching element, allows applicant to provide a switch of small height, especially when a downward housing projection 48 lies in a hole of a circuit board.

Figure 4:
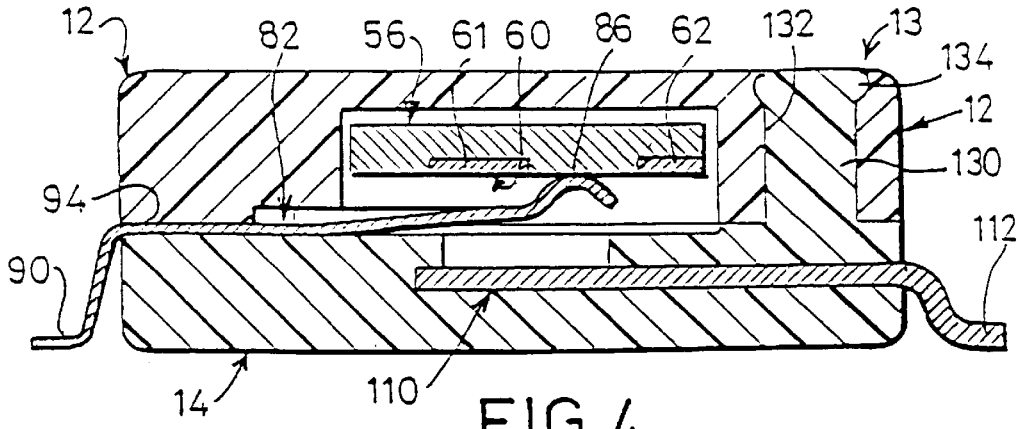
FIG. 4 is a sectional view taken on line 4—4 of FIG. 5.
Figure 5:
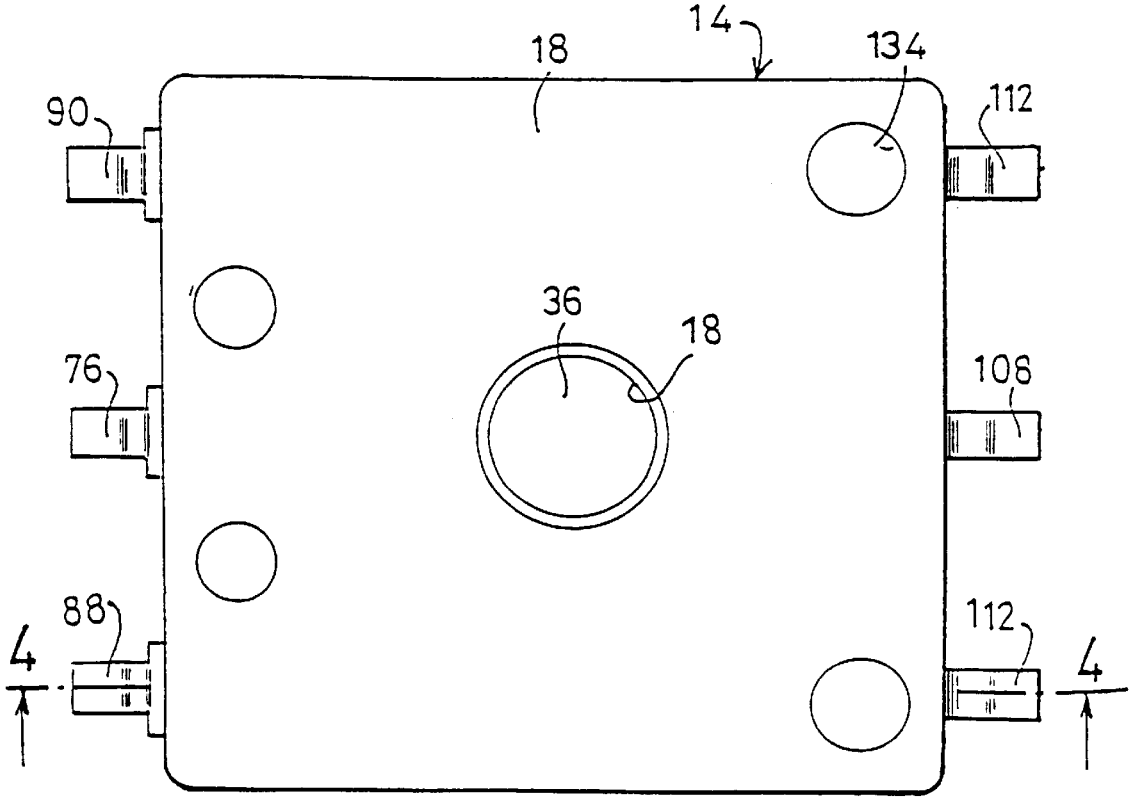
FIG. 5 is a plan view of the switch of FIG. 2.
Figure 7:
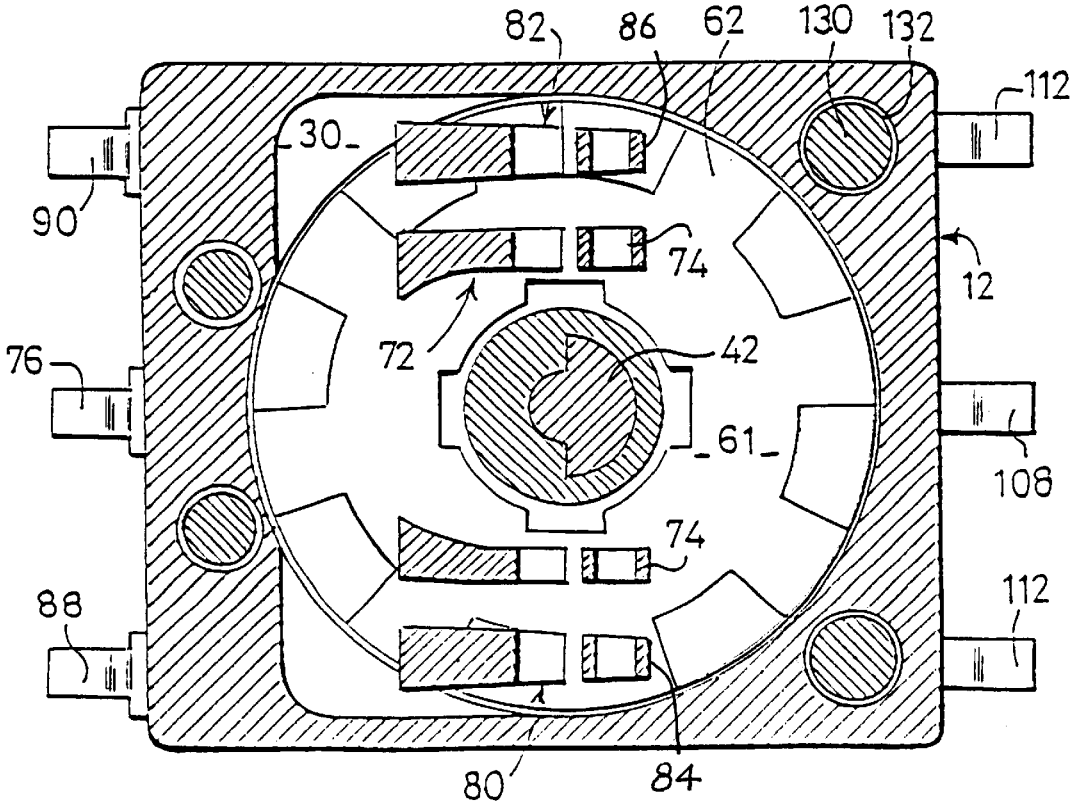
FIG. 7 is a sectional view taken on line 7—7 of FIG. 6.

It is noted that during downward movement of the actuation member 36, the coding wheel 52 including the insulative disc 54 and the contacting star element 60 are depressed. As shown in FIGS. 4 and 7, the pivot switch contacts 72, 80, 82 are long. This provides resilience so that the contacting ends 84, 74, 86 can deflect by the small distance required for the dome switch element to be depressed against the terminal portion 106 of FIG. 3. It would be possible to have the coding wheel turn with the actuation member but not slide with it, but the short distance of sliding enables such sliding to occur without deleterious effect on the contacting parts 84, 74, 86 of the contacts. In fact, during such downward displacement of the contacts, 84, 74, 86, a self-wiping effect occurs between the convex free ends and the lower face of the star element 60.

The terminals 102, 104 of FIG. 1 can be molded in place in the housing lower part. The coding wheel 52 can be force fit onto the actuation member 36, and the actuation member then inserted upwardly through the hole 18 in the upper housing part. The contacts 72, 80, 82 and the dome switching element 100 can be stacked on the lower housing part over the dome switching element and related contacts. Then, the upper housing part can be moved down against the lower housing part and fixed thereto, as by ultrasonic welding or by adhesive.

In a switch that applicant has deigned, the height B (FIG. 3) of the switch housing was 2.75 mm and its width and length were respectively 7 mm and 8 mm. This results in a switch of very small size, which is suitable for small electronic devices such as a portable telephone or cell phone. The switch has a minimum of components that are easily assembled in a rugged construction.

While terms such as "vertical", "horizontal", etc have been used to describe the switch and its parts as illustrated, it should be understood that the switch and its parts can be used in any orientation with respect to the Earth.

Thus, the invention provides a small and versatile electrical switch assembly. The switch assembly includes a dome switching element and an actuation member that can depress the element, with the actuation member having a lower portion that extends through a hole in the switching element and which is guided by a lower wall of the switch housing. A coding wheel is mounted on the actuation member and is preferably fixed to it to provide additional switching functions by rotation of the actuation member about its vertical axis. The lower wall of the housing can include a downward projection that extends the length of the hole in which the lower portion of the actuation member is guided, with the projection preferably lying in a hole in a circuit board on which the switch is mounted.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electric switch assembly, comprising:

a housing having an upper housing portion with a vertical upper bore that has a vertical axis, said housing having a lower housing portion;

an actuation member which is movable vertically along said vertical upper bore;

a resiliently deformable switching element which has a first part that is connected to a first terminal, said switching element having a second part that is upwardly biased to an upward position but which can be resiliently deflected downwardly against a second terminal;

said second part of said switching element having a hole, said actuation member having a lower portion that extends through said hole, and said lower housing portion has a vertical lower bore that lies below said switching element and that is aligned with said upper bore, said actuation member having a lower end that lies in said lower bore and that is vertically slideable therein.

2. The switch assembly described in claim 1 wherein:

said switching element comprises a piece of sheet metal which is deformed into a dome shape with a dome center that forms said hole.

3. The switch assembly described in claim 1 including:

a coding wheel that is rotatably fixed to said actuation member to pivot about said axis with said actuation member, said coding wheel having at least one contacting part and one space lying on an imaginary circle;

a plurality of contacts with engaging parts positioned in vertical alignment with said circle, so each contacting part is positioned to engage and not engage said at least one contacting part as said coding wheel is selectively pivoted about said axis.

4. The switch assembly described in claim 1 including:

a circuit board that has a hole;

said lower housing portion has a lower surface lying below a bottom of a majority of the housing, and said lower housing has a downward projection that projects into said circuit board hole, said downward projection forming a portion of said lower bore.

5. The switch assembly described in claim 1 including:

a collar that is fixed to said actuation member and that lies above said switching element, said collar extending in a ring about said axis and having a cross-section along said ring that has a convex lower surface to depress said switching element.

6. The switch assembly described in claim 1 wherein:

said switching element includes a sheet of conductive material with a convex upper surface, a concave lower surface, and a periphery, and a central hole, said actuation member lower portion projecting through said hole;

said first terminal lies under said periphery to constantly engage said switching element and said second terminal lies under a middle portion of said switching element to engage said middle portion when said middle portion is depressed.

7. A switch assembly comprising:

a housing that includes upper and lower housing parts with peripheries that are joined, said housing parts forming an internal cavity between them, said cavity having top and bottom walls that have aligned bores;

an actuation member having an upper portion projecting through the bore in said upper wall and having a lower portion lying in said bore in said lower wall, said actuation member being vertically slideable in said bores;

a resilient dome-shaped switching element;

pair of contacts including a first contact in engagement with a periphery of said switching element and a second contact lying under a center portion of said switching element;

said dome-shaped switching element has a hole and said actuation member lower portion projects through said hole.

8. The switch assembly described in claim 7 including:

a circuit board with conductive traces, said contacts engaged with said traces, and said circuit board having a board hole; and wherein said bottom wall has a downward projection that forms at least a portion of one of said bores, said projection projecting into said board hole.

9. The switch assembly described in claim 8 wherein:

said bore in said projection, extends to an extreme bottom of said projection.

10. The switch assembly described in claim 7, wherein:

said actuation member is pivotable about a axis that passes through said bores, between first, second and third rotational positions;

a coding wheel fixed to said actuation member to turn with said actuation member, said coding wheel having at least one conductive tooth and a gap both lying on a circle centered on said axis;

at last two pairs of coding contacts positioned below said circle, said pairs of coding contacts positioned so only a first pair of said coding contacts and only a second pair of said coding contacts is engaged by said at least one tooth in said first and second member positions, respectively, and with neither pair engaged with said at least one tooth in said third position.

11. An electrical switch assembly, comprising:

a housing having an upper housing portion with a vertical upper bore, said bore having a vertical axis;

an actuation member which is moveable vertically along said vertical bore and which is pivotable about said axis;

a resiliently deformable switching element which has a first part that is connected to a first terminal and that is supported on said housing against downward movement, said switching element having a second part that is biased to an upward position but which can be resiliently downwardly deflected against a second terminal;

a conductive coding wheel which is rotatably fixed to said actuation member to pivot about said axis with said actuation member, said coding wheel having at least one conductive tooth and one space lying on an imaginary circle centered on said axis;

a plurality of contacts with engaging parts positioned in vertical alignment with said circle, so each of the contacting parts engages and does not engage a selected one of said engaging parts as said coding wheel is selectively turned;

said engaging parts positioned to allow vertical movement of said actuator member to downwardly deflect said second part of said switching element against said second terminal and to release said second part of said switching element to allow said second part and said actuation member to move to an upward position;

said second part of said switching element has a hole, said actuation member has a lower portion that extends through said hole, and said housing has a lower housing portion with a lower bore that lies below said hole and that guides said lower portion of said actuator member in vertical movement.

* * * * *